United States Patent [19]

Kitchen, III

[11] Patent Number: 4,585,462

[45] Date of Patent: Apr. 29, 1986

[54] COMBUSTION IMPROVER FUEL ADDITIVE

[76] Inventor: George H. Kitchen, III, 646 Lakeview Cir., Rio Rancho, N. Mex. 87124

[21] Appl. No.: 629,444

[22] Filed: Jul. 10, 1984

[51] Int. Cl.[4] ..... C10L 1/22

[52] U.S. Cl. ..... 44/62; 44/63; 44/66; 44/68; 44/72; 544/215

[58] Field of Search ..... 44/66, 68, 56, 63, 72, 44/62; 544/215

[56] References Cited

U.S. PATENT DOCUMENTS

| | | | |
|---|---|---|---|
| 1,916,735 | 7/1933 | MacLean | 44/66 |
| 2,943,925 | 7/1960 | Ambrose | 44/66 |
| 3,785,789 | 1/1974 | Honnen et al. | 44/66 |
| 3,915,970 | 10/1975 | Limaye et al. | 44/63 |
| 4,173,456 | 11/1979 | Scheule et al. | 44/73 |

*Primary Examiner*—William R. Dixon, Jr.

*Assistant Examiner*—Margaret B. Medley

*Attorney, Agent, or Firm*—Jerry W. Berkstresser; Bruce G. Klaas

[57] ABSTRACT

It has been discovered that a fuel additive comprising a major proportion of a high molecular weight amine, and minor proportions of naphtha and a polyalphaolefin synthetic oil, together with a small amount of a biocide and a minor proportion of a manganese-containing organometallic compound, preferably manganese linoleate, can be combined with fossil fuels in a ratio of about one part additive to 8,000 parts of fuel to produce a combustion efficiency improvement together with an inhibition of polymerization and bacteria, as well as a rust inhibitor, in stored fuels which is capable of depolymerizing and dispersing sludge and sludge forming polymers in stored fuel as well as improving the combustion efficiency of such fuels in use by improving fuel consumption in relation to heat output while reducing soot and scale and emissions.

6 Claims, No Drawings

COMBUSTION IMPROVER FUEL ADDITIVE

BACKGROUND OF THE INVENTION

This invention relates to fuel additives and more particularly to additives which can improve the combustion efficiency of fossil fuels in such uses as boiler fuels and the like, as well as reducing combustible scale formation, firebox corrosion and emissions.

Fuel additives to catalytically increase the combustion efficiency of fossil fuels have been available for some time. Initially, they attracted little commercial interest because of the relatively low cost of fuel oil. In the mid-sixties the price of bunker C fuel oil was only six cents a gallon and even #2 diesel fuel cost less than twenty cents a gallon. For that reason, an up to five per cent increase in fuel efficiency was not considered sufficiently important to warrant extensive development. Today, since fuel oil prices are five or six times those of the sixties, the possibilities for increasing fuel efficiency are more attractive and are being investigated.

Nevertheless, the development of boiler fuel additives containing combustion improving catalysts have not been employed extensively by large consumers of fuel oil despite the fact that they have proven to be capable of cutting fuel bills by up to 5 per cent due to several unresolved drawbacks.

In particular, a combustion improving additive has not been provided which will also stabilize stored fuel.

A suitable combustion improving catalyst additive should promote more complete combustion and reduce deposits of carbon residue in boiler tube scale, and soot and acid smut in stack emissions. A reduction in the amount of carbon deposited on surfaces of a combustion chamber of a boiler is extremely important to the efficient transfer of heat to the boiler tubes. The build up of a layer of uncombusted materials, including carbon, on the walls of a boiler combustion chamber can have up to five times the thermal insulating value of asbestos and can very significantly reduce heat transfer. Thus a properly formulated combustion improver having this property can reduce maintenance requirements, improve heat transfer and clean up emissions, while providing more complete combustion of the carbon in the fuel, thus utilizing more of the theoretical B.T.U. content of the fuel.

In addition, any newly formulated boiler fuel additive should also be able to act as a fuel stabilizer. This stabilization is especially important with stand-by oil heating systems such as those which back up gas fired boilers in many areas of the country when extremely cold weather increases gas consumption causing line pressures to drop significantly, requiring the use of the stand-by oil fired system. Fuel oil begins to deteriorate as soon as it is produced. This presents no major problem if it is consumed relatively quickly. However, in stand-by systems, fuel may be stored for long periods and its deterioration affects both its combustibility and pumpability.

The catalytically cracked fuel oils available today age, tend to repolymerize forming submicronic particles which can plug fuel filters and atomizers. As the process continues, the repolymerized molecular weight of the particles increases, favoring the formation of agglomerates and sludge which is accelerated by the current practices. Eventually sludge renders the fuel unpumpable under the conditions of use.

The rate of repolymerization is a direct function of age and energy input into the fuel. This means that the practice of periodically pumping and filtering stand-by fuel supplies to remove sludge, as practiced by some fuel service companies, does more harm than good, unless the polymerized agglomerates are depolymerized and dispersed. Unless a suitable fuel stabilization additive having propeties which retard the formation of agglomerations is provided in the fuel, such pumping will actually hasten the repolymerization process.

Finally, bacteria present in the fuel can also create an agglomeration problem with stored fuels by providing sites for repolymerization. These bacteria feed on nitrogen, sulfur and iron oxides. Since these materials are almost always present in fuel tanks, a good biocide is also necessary in any fuel stabilization formulation.

Therefore, in addition to improving combustion efficiency, a properly formulated fuel oil additive must be able to stabilize the fuel in storage. Combustion improving fuel additives should therefore contain such ingredients as dispersants to control repolymerization, biocides to control bacteria growth, detergents to keep lines and nozzles clean, a metal deactivator to suppress copper and zinc which act as repolymerization catalysts, and corrosion inhibitors to facilitate long term fuel storage as well as providing a catalytic combustion improver.

It is an objective of this invention to provide a fuel additive for fossil fuels which promotes improved combustion efficiency as well as fuel stability during long term storage.

BRIEF DESCRIPTION OF THE INVENTION

A fossil fuel additive for achieving the foregoing objectives is provided containing in predetermined amounts a minor proportion of an organometallic manganese-containing compound in combination with a major proportion of a high molecular weight amine for depolymerizing and dispersing polymerized fuel agglomerates, a minor proportion of a naphtha and a polyalphaolefin synthetic oil and a small amount of a biocide, the foregoing being combined with fossil fuels in a ratio of about one part of additive to 3000–10,000 parts by weight and preferably about 8,000 parts by weight of the fuel to improve the stability and the combustion efficiency of the fuel.

DETAILED DESCRIPTION OF THE INVENTION

In the past, fuel has been treated to improve combustion efficiency and to protect fireside surfaces from high temperature corrosion, and carbon-containing scale build up. Typical additive packages have been used based on oil soluble organometallic compounds of manganese in fuel. Unfortunately, the compounds used previously were extremely toxic and consequently difficult to store and handle. It has been discovered that the following formulation produces improved results over the prior formulations without the hazards mentioned hereinbefore.

PARTS BY WEIGHT

20 Manganese linoleate
50 EDA-3
14.95 5 cs PAO non-compounded Synthetic Oil
15 HA-40
0.05 Onoxide 200

In the past, a wide variety of chemical compositions have been provided as fuel additives. Unfortunately, many of these compositions when used as recommended by their manufacturers did not provide all of the properties which overall were required for an effective inhibitor, or reinhibitor and depolymerizer for the long term storage of kerosene and diesel fuel, as well as providing combustion efficiency improvement.

The composition of the present invention utilizes a major proportion of a proprietary composition presently sold by the Ethyl Corporation under the trademark EDA3.

This clear amber liquid composition contains a high molecular weight amine, is basic and is believed to be a polymerization product of an analog or homolog of ethylene diamine. The boiling point range of this composition begins at about 240° F. (116° C.). It is insoluble in water and has a density of 0.899 gm/l at 68° F. (20° C.). This composition is recommended by the manufacturer as the sole fuel additive to be used as an inhibitor of sludge formation. In addition to the foregoing, the EDA-3 contains additives which inhibit rust, such as certain chelating agents, and which help to demulsify and disperse sludge that is formed.

At 100% usage however, this composition does not properly diffuse in the fuel sufficiently to effectively provide any depolymerization function. When this composition is diluted with an aromatic solvent, such as naphtha (HA-40) in a manner contrary to the recommendation of manufacturer, in the proportions described hereinafter, the combination provides a more workable, effective depolymerizing agent which also helps to prevent wax build-up which can be a problem in severe cold. Preferably, a naphtha, purchased from Union Chemicals Division of Union Oil Company of California, designated HA-40, is used. This composition contains both single and double ring aromatics having a boiling range of from about 420° F. (216° C.) to about 545° F. (285° C.) and a specific gravity at 60° F. (16° C.) of about 0.98. This composition is also not soluble in water.

Due to the strong solvent action of the naphtha, it is desirable for the composition to contain a minor proportion of a polyalphaolefin, non-compounded synthetic oil such as Synfluid 5 cs sold by the Gulf Oil Company. This aliphatic hydrocarbon based synthetic oil, when used in the composition in about 25 parts per 100 parts of total composition, helps to provide the required lubricity for diesel injectors, pumps and the like.

Finally, most fuel additive compositions attempt to prevent polymerization due to bacteria growth and the subsequent sludge formation, by the use of up to 5% by weight of a biocide. Contrary to this prior practice, it has been found in the present composition that about 0.05 parts per 100 parts of the composition is an adequate level for the biocide selected. The preferred biocide used in the present invention has an impercal formula of ($C_9H_2$, $N_3O_3$). This component is sold by ONYX Chemical Company of Jersey City, N.J. under the trademark ONYXIDE 200.

Suprisingly the foregoing compounds when compounded as described hereinafter, containing a fuel soluble fatty acid ester, and most preferably 20 parts by weight of manganese linoleate, synergistically provides the desired improvement in combustion efficiency in use, as well as providing a significant fuel stability during pumping and storage, over that which is obtainable without the addition of the manganese linoleate.

To properly prepare the composition of the present invention, the ONYXIDE 200 is first added to one half of the HA-40. Next, the EDA-3 is added to one-half of the HA-40. The manganese linoleate is then dissolved in the polyalphaolefin and the mixture is then diluted with the other half of the HA-40. Finally the two HA-40 components containing the foregoing components are thoroughly mixed together.

As previously discussed, the prior compositions for inhibiting the formation of sludge forming polymers, bacteria, and the prevention of rust in fuel storage tanks, were not particularly effective when subsequently applied to fuel storage tanks, where polymerization and sludge had already formed to any substantial extent. Without being bound to any particular theory, it is proposed that the formation of macroscopic sludge, even if temporarily prevented by other additive compositions, such as present in EDA-3, after formation tends to reagglomerate relatively quickly thereby posing the same drawbacks to the fuel pick up, transfer, pumping which can deleteriously effect engine injector systems.

The composition of the present invention after successfully solubilizing or subdividing the macroscopic sludge also provides the capacity of dispersing the submacroscopic sludge or agglomerates thereof thereby retarding subsequent reagglomeration. This action in concert with the inhibition of polymerization provided by the components of the composition, in the quantities recited has been shown to be an effective fuel additive for stored fuel when used in a routine program of preventative maintenance.

The particular action described minimizes the effect of bacteria, oxygen and even rust formation on the polymerization mechanisms that can occur in stored fuel.

Since none of the prior compositions effectively catalytically improved combustion efficiency, or significantly reduced the formation or retention of agglomerated polymerizates in the form of gels and sludge, this composition and method has hitherto not been achieved.

In comparison tests, the composition of the present invention has provided a hitherto unachieved benefit in this field. Analysis of boiler scale taken from the first and second pass tubes of a boiler fired for one year with fuel that did not contain the additive of this invention contained scale having 70.2 and 61.6 percent combustibles respectively after the one year of operation. Utilizing the additive of the present invention, only 7.02 percent combustibles were found in scale from the first pass tubes and only 19.2 percent in scale from the cooler second pass tubes. In addition, the scale that was formed using the fuel additive of the present invention, was powdery and was easily brushed off the tube surfaces. The former scale, however, in addition to the high proportion of combustibles was also difficult to remove.

Other observations on the scale formed using the additive of the present invention was the fact that there was a 300° F. increase in the melting point of the scale, with an observed absence of corrosive low-melting-point sulfate deposits, compared to the scale formed with fuels not containing the additive described herein.

The sizeable decreases in scale combustibles, 90% in one case and 69% in the other, indicate a significant reduction of smoke and soot and therefore more complete combustion using a fuel treated with the additive of the present invention.

At today's fuel oil prices, the use of combustion catalysts to improve fuel efficiency would seem to make economic sense. For a cost of only about $0.01 per gallon of treated fuel, combustion efficiency can be increased from 3 to 7 percent and fuel comsumption reduced proportionally. At today's prices for #2 fuel oil, 5 percent greater efficiency can save from 5 to 6 cents a gallon, a 500-plus per cent return. In addition, more complete combustion reduces boiler scale, soot, smoke and corrosion.

Other advantages of a properly formulated boiler fuel additive, as described herein, include greater fuel stability and reduced fuel system corrosion and maintenance.

The present invention has been described in its most preferred embodiments. It will be appreciated that minor modifications in the proportions of the formulation described which produce similar results are contemplated to be within the invention disclosed. In addition, other fatty acid esters, such as the oleate, naphthanates, and the like, which are fuel soluble, may be substituted herein for the manganese linoleate. The scope of this invention is not intended to be restricted by this disclosure but rather only by the applicable prior art as applied to the appended claims.

I claim:

1. A fuel additive for improving the combustion efficiency and storage stability of stored fuel which is capable of reducing the amount of macroscopic sludge particles formed from polymerization reactions promoted by bacteria and oxidation in fuel and improving the combustion efficiency of the fuel and reducing the soot emissions and scale formation of such fuel in a combustion chamber when used in amounts of from about one part of additive composition to between 3000 to about 10,000 parts by weight of fuel and containing in parts by weight per 100 parts by weight of additive about 50 parts by weight of a polymerizate of ethylene diamine, about 15 parts by weight of a naphtha solvent, about 15 parts by weight of a polyalphaolefin based synthetic oil, about 0.05 parts by weight of a miscible biocide, and about 20 parts by weight of manganese linoleate.

2. The fuel additive of claim 1 wherein the biocide is Hexahydro-1, 3, 5-Tris (2 Hydroxyethyl) S-Triazine.

3. A method of improving combustion and reducing macroscopic sludge in fuel stored in fuel storage tanks consisting of the step of:

adding to said fuel a composition consisting essentially of:

about 50 parts, out of 100 parts by weight of said composition of a polymerizate of ethylene diamine;

about 15 parts by weight of a naphtha solvent;

about 15 parts by weight of a polyalphaolefin synthetic oil, about 0.05 parts by weight of a biocide miscible in said solvent, and about 20 parts by weight of a manganese linoleate; one part by weight of said composition being added to between 3000 to about 10,000 parts by weight of fuel.

4. The method of claim 3 wherein the biocide is Hexahydro-1, 3, 5-Tris (2 Hydroxyethyl) S-Triazine.

5. A fossil fuel having between 3,000 to about 10,000 parts by weight for each part of a composition comprising:

about 50 parts, out of 100 parts by weight of said composition of a polymerizate of ethylene diamine;

about 15 parts by weight of a naphtha solvent;

about 15 parts by weight of a polyalphaolefin based synthetic oil and about 0.05 parts by weight of a biocide miscible in said solvent, and about 20 parts by weight of a miscible manganese linoleate.

6. The fuel of claim 5 wherein the biocide is Hexahydro-1, 3, 5-Tris (2 Hydroxyethyl) S-Triazine.

* * * * *